United States Patent [19]

Hoffmann et al.

[11] 4,093,133

[45] June 6, 1978

[54] FORMATION OF A RESERVE WINDING THREAD OF DEFINED LENGTH ON BOBBINS OF A TEXTILE MACHINE

[75] Inventors: Herbert Hoffmann, Bremen; Friedrich Wachendorf, Eggestedt, both of Germany

[73] Assignee: Fried. Krupp Gesellschaft mit beschrankter Haftung, Essen, Germany

[21] Appl. No.: 723,492

[22] Filed: Sept. 15, 1976

[30] Foreign Application Priority Data

Sep. 20, 1975 Germany ..... 2542000

[51] Int. Cl.[2] ..... B65H 54/02

[52] U.S. Cl. ..... 242/18 PW; 242/18 A

[58] Field of Search ..... 242/18 PW, 18 A

[56] References Cited

U.S. PATENT DOCUMENTS

| | | | |
|---|---|---|---|
| 3,559,903 | 2/1971 | McDermott et al. | 242/18 PW |
| 3,741,488 | 6/1973 | Wvest | 242/18 PW |
| 3,791,126 | 2/1974 | Kose et al. | 242/18 A X |
| 3,948,452 | 4/1976 | Burysek et al. | 242/18 PW |
| 3,952,959 | 4/1976 | Shaw et al. | 242/18 PW |
| 3,964,722 | 6/1976 | Boggs et al. | 242/18 PW |

*Primary Examiner*—Harvey C. Hornsby
*Assistant Examiner*—John M. Jillions
*Attorney, Agent, or Firm*—Spencer & Kaye

[57] ABSTRACT

In a method and apparatus for winding yarn onto a bobbin in a textile machine in a manner to form a reserve winding at one end of the bobbin, the yarn forming the reserve winding is given an accurately determined length by drawing a length of yarn greater than the predetermined length into a suction device before commencing winding of a bobbin and then cutting the yarn at a predetermined point beyond the inlet end of the suction device at a time bearing a fixed relation to the catching of the yarn by a catch element associated with the bobbin. The timing of the cutting operation is controlled by monitoring the instant at which the inlet end of the suction device is moved to a position at which the yarn can be caught by the catch element.

11 Claims, 8 Drawing Figures

FORMATION OF A RESERVE WINDING THREAD OF DEFINED LENGTH ON BOBBINS OF A TEXTILE MACHINE

BACKGROUND OF THE INVENTION

The present invention relates to the formation of a tie-on thread of defined length at the bobbin of a textile machine in a procedure in which, after severing of the yarn at a point between the full bobbin and a yarn supply device, the yarn which is continuously supplied by that device is removed by means of a suction device and brought into engagement with a catch element which carries along the yarn in the direction of rotation of the bobbin and thus initiates the winding of both a yarn reserve and the principal winding on the bobbin.

This operation is carried out in an apparatus which includes a bobbin holder provided with two bobbin arms between which a bobbin can be held via rotatably mounted bobbin discs, one of the discs being provided with a catch element at its periphery, the apparatus further including a yarn supply device associated with the bobbin holder and a suction device including a suction tube and a collecting vessel.

In a known winding device for producing cylindrical yarn bodies in textile machines, the yarn which continues to be supplied after removal of a full bobbin is manually introduced into a suction device and during insertion of the empty bobbin and its contact with the slotted drum that drives it, a guide element is moved into an outer end position in the direction toward one of the bobbin arms to thus bring it into engagement with a catch hook which rotates together with the bobbin disc adjacent the guide element.

Upon severing of the yarn in communication with the suction device and winding of a transitional end piece onto an end region of the bobbin, the guide element is returned to its starting position so that the normal winding process can begin.

One drawback of this known apparatus is that the tie-on thread which is formed has an arbitrarily variable length. Tie-on threads which are too long in many cases cause difficulties during connection with a subsequent bobbin and, under certain circumstances, require additional process steps to shorten the tie-on thread, which at the same time involve greater yarn losses.

Moreover, there are a known process and apparatus for exchanging full bobbins for empty bobbins in textile machines, in which the end of the yarn which continues to be furnished by a yarn supply device is introduced substantially at the removal speed into the interior of the empty bobbin and the latter, before it is clamped into the machine, is preliminarily driven at the bobbin speed, and the yarn is held by being guided above the bobbin edge to be caught by the bobbin and wound onto the empty bobbin.

One embodiment of the apparatus for practicing this method is provided with an S-shaped subatmospheric pressure tube which can be pivoted between two end positions and which carries along the yarn sucked thereinto when it is pivoted into the interior of the empty bobbin. In one end position of the subatmospheric pressure tube the yarn is caught by a notch in the edge of the bobbin so that severing of the yarn section disposed in the subatmospheric pressure tube produces a yarn reserve and thereafter the actual wound bobbin.

One drawback of this known process and apparatus is that upon completion of the winding process there is no loop-shaped tie-on thread of defined length available which would permit further use of the bobbin without difficulty.

SUMMARY OF THE INVENTION

It is an object of the present invention to form a tie-on thread of defined length at a bobbin in association with formation of a loop.

The purposes of the present invention are mainly to increase operational dependability and to provide the simplest structure possible, i.e., to avoid the need for complicated control devices.

It is a further object of the invention to reduce the yarn losses incurred during formation of the tie-on thread.

These and other objects are achieved, according to the invention by a method of the above-mentioned type which substantially includes the following process steps:

Feeding the winding yarn, before it is severed, to the suction device by moving a guide element and the entrance region of the suction device in front of the bobbin;

Bringing the length of yarn in communication with the suction device, after severing, into the area of the plane of rotation of the catch element by moving the entrance region and the guide element behind the newly inserted empty bobbin and, after the yarn has been caught, forming a tie-on reserve winding by drawing a reserve thread; and Moving the entrance region into the catch position behind the bobbin to initiate a severing process with which a reserve thread of preselectable length is severed from the already furnished yarn material behind the entrance region.

Preferably the reserve thread is deflected from the plane of rotation of the catch element in the direction toward the empty bobbin immediately after the catching step and the winding yarn connected to the yarn supply device is transferred to the winding region.

The concept underlying the method of the invention is thus that, on the one hand, the yarn is fed to the bobbin in a certain manner to form a yarn loop and the tie-on reserve winding is formed by feeding back the yarn material already removed by means of the suction device and, on the other hand, a severing process is associated with the yarn catching process in such a manner that a tie-on thread of fixed length is formed each time outside the winding area, or region, of the bobbin. The formation of a tie-on thread of fixed length can be assured by effecting the severing process at a certain distance behind the entrance region.

According to an advantageous embodiment of the invention, the moment of occurrence of the severing process is shifted in time with respect to the catching process, i.e., at the time at which the suction device has reached the catch position.

According to a further modification of the process, the severing of the winding yarn takes place behind the entrance region of the suction device, relative to the direction of travel of the winding yarn. By this mode of operation the winding yarn which may possibly be under strong tension, is prevented from leaving the effective range of the suction device when severed, which would prevent it from being sucked into the suction device through its entrance region.

The apparatus contemplated by the present invention is characterized substantially in that the suction tube, which includes a guide element in the area of its suction opening and a cutting device, is mounted at a point outside of its entrance region to be rotatable about its longitudinal axis, and, at an adjustable distance from the suction opening, a severing device is provided which extends into the suction tube and whose cutting member is actuatable in dependence on the position of the entrance region once the suction tube has reached the catch position.

The apparatus can advantageously be designed so that a guiding device is mounted ahead of the bobbin in the area of the plane of rotation of the catch element to deflect the winding yarn carried along by the catch element in the direction toward the bobbin.

According to a preferred embodiment of the apparatus, the guide member and the cutting device are fastened to the suction tube so that in the suction position, in which the entrance region of the suction tube is disposed in front of the bobbin, the guide member lies behind the suction opening and in front of the cutting device.

According to a further advantageous embodiment of the apparatus, an abutment switch is associated with the entrance region and is arranged to be actuated when the entrance region is in the catch position, the switch being connected to a control device so that when the switch contacts the entrance region, the drive for the cutting device is switched on.

In order to adapt the length of the tie-on thread, for example, in dependence on the yarn number or size, or on the supply speed, to various operating conditions, the control device is advantageously provided with a delay member having a preselectable permanently settable delay period. By setting the delay period, the length of the reserve yarn removed from the suction tube before the severing process can be controlled.

The apparatus may be designed so that the suction tube together with the collecting vessel and the cutting device, as well as the guiding device, form a movable unit with which a plurality of bobbins can be handled.

According to a further embodiment of the apparatus, the movable unit includes a carrying frame with a centering surface to be placed onto the machine frame as well as a suction tube which has a sealed connection through which, when the centering surface is in position, a connection can be established with a stationary suction line provided with sealable connecting openings.

DESCRIPTION OF THE PREFERRED EMBODIMENTS

Figure 1A:
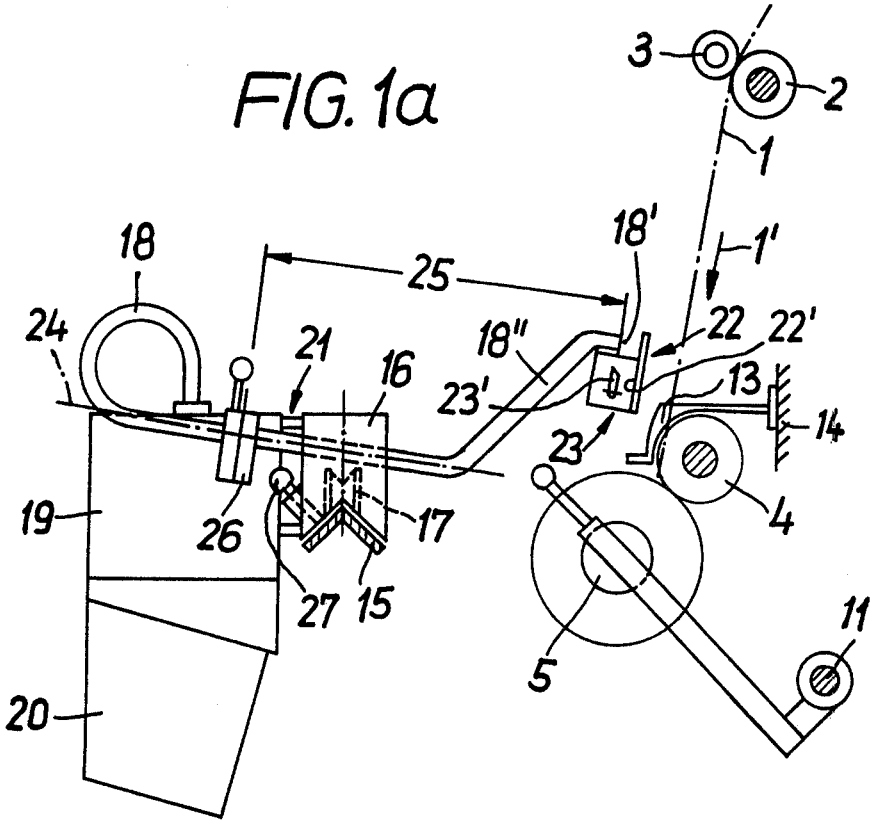
FIGS. 1*a* and 1*b* are a side elevational view and a top plan view, respectively, of an embodiment of apparatus according to the invention for forming a tie-on thread of defined length.
Figure 1B:
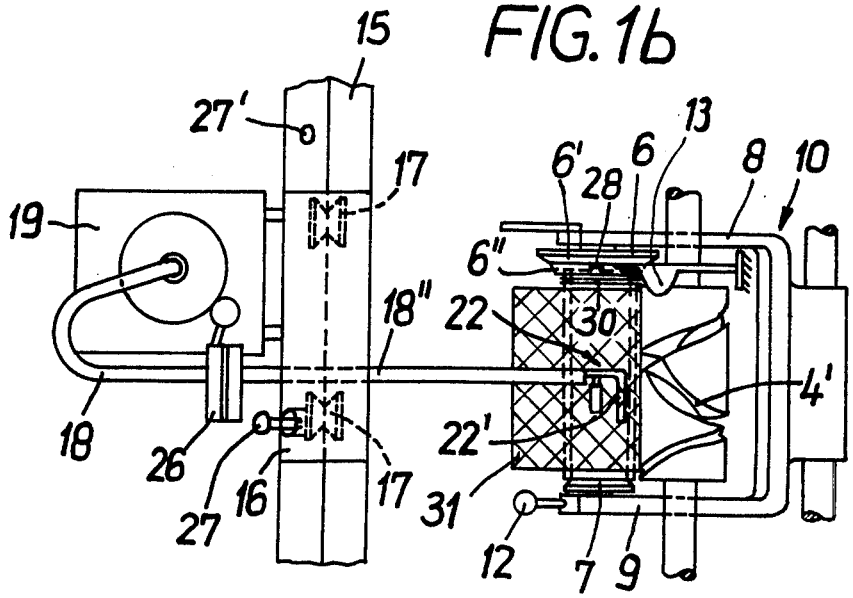

In the apparatus illustrated in FIGS. 1a and 1b, yarn 1 coming from the textile machine, for example, an open-end spinning machine (not shown), is fed by means of a yarn supply device including a delivery cylinder 2 and a pressure roller 3, and with the aid of a grooved or winding drum 4, to a bobbin 5 and is wound thereonto in the principal winding region thereof. The yarn is guided in grooves 4' of the drum 4 as the latter rotates to produce, for example, a criss-cross winding. The bobbin 5 is clamped between two bobbin discs 6 and 7 which themselves are rotatably mounted in respective ones of two bobbin arms 8 and 9 of a bobbin holder 10. Bobbin holder 10 itself is mounted to be pivotal about a stationary axis 11. Release of a full bobbin 5 is effected by pivoting bobbin arm 9, which is provided with an actuating lever 12 for that purpose, away from the bobbin toward the outside, the linkage therefore not being shown.

Looking in the direction 1' of movement of yarn 1, a guiding device 13 is connected ahead of bobbin 5 and is permanently connected to machine frame 14.

The machine can be provided with a plurality of bobbin holding units arranged so that their associated bobbins are juxtaposed in axial alignment.

In front of the juxtaposed bobbin positions, and parallel to the bobbin axes, there is disposed a guide rail 15 which extends in the longitudinal direction of the bobbins and substantially includes a unit 21 composed of a carriage 16 with supporting rollers 17, a suction tube 18, a collecting vessel 19 and a suction blower 20.

Suction tube 18 is provided with a suction opening 18' in front of which there is disposed a guide member 22 and a cutting device 23 fastened to suction tube 18 so that it is disposed behind, or upstream of, the suction opening 18', when seen in the direction of movement of yarn 1, when the suction tube is in its starting position, which position is illustrated in FIGS. 1*a* and 1*b*. Guide member 22 is provided with a guide surface 22' which faces the suction opening 18'.

Suction tube 18 opens into collecting vessel 19 and the suction tube entrance region 18'', which follows opening 18', is mounted in carriage 16 to be pivotal about an axis 24. At a distance 25 from suction opening 18' of suction tube 18, there is provided a severing device 26 which permits severing of yarn so that the length of yarn between opening 18' and the point of severance is determined by distance 25. The severing device 26, or its cutting portion, is coupled with the rotatable entrance region 18'' of suction tube 18 in such a manner that the severing process takes place at that point in time when the suction tube has reached its catching position behind bobbin 5, this position being illustrated in FIG. 2*d*.

A resilient arresting pin 27 is attached to carriage 16 to accurately position the carriage at each individual bobbin location of the spinning machine by engaging in the selected one of appropriately arranged bores 27' in guide rail 15.

The periphery of disc 6 is composed of a shallow conical peripheral surface 6'' and a steep conical peripheral surface 6', the latter being provided with a hook-shaped catch element 28 presenting a yarn intercepting opening facing in the direction of rotation of the bobbin. The winding surface of bobbin 5 is divided into a reserve winding region for accommodating the reserve winding 30 and a principal winding region for accommodating the bobbin windings 31. The deflector 29 of the guiding device 13 serves to deflect the winding yarn into the area of grooves 4' of winding drum 4 after the catching operation. The winding drum 4 and pivot axis 11 of holder 10 are held in machine frame 14.

In one modification of the above-described embodiment, the guiding device may also be permanently connected to unit 21 so that only one guiding device is required for a plurality of bobbin positions.

Figure 2A:
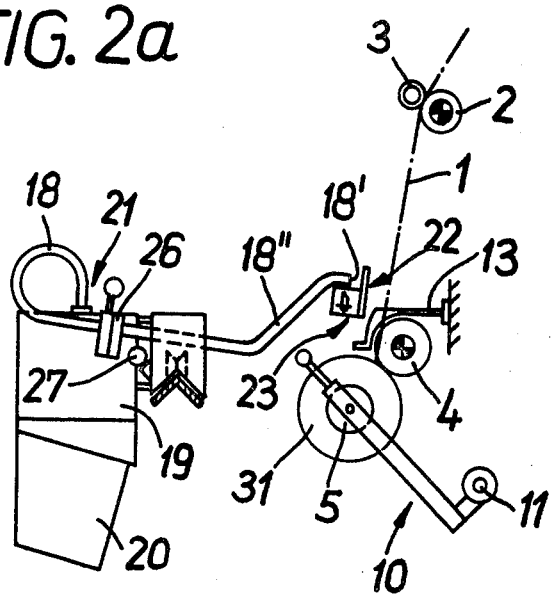
FIGS. 2*a*, 2*b*, 2*c* and 2*d* are side elevational detail views of a part of the apparatus of FIG. 1 in successive operating positions.
Figure 2B:
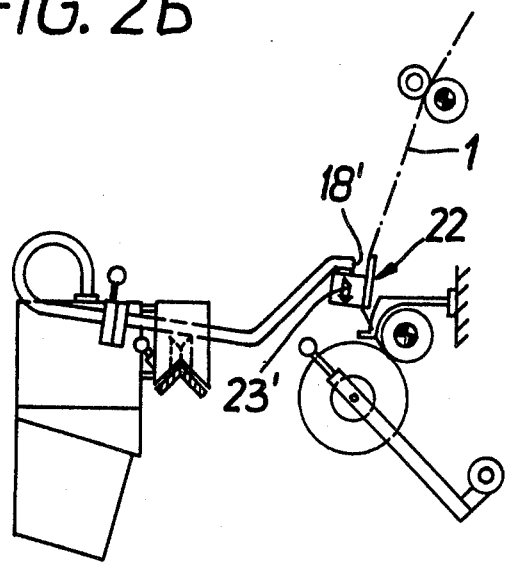

The apparatus shown in FIG. 1 operates as follows:

Upon completion of a winding process, i.e. completion of bobbin winding 31 shown in FIGS. 1*b* and 2*a*, unit 21 is positioned by means of arresting pin 27, and yarn 1 coming from the textile machine is placed over guide surface 22' of guide member 22, as shown in FIG. 2*b*. Thereafter, blade 23' of cutting device 23 is moved to sever the yarn 1 below the suction opening 18' and guide member 22.

The cutting process, which may be automatic or manual, takes place sufficiently far below suction opening 18' that the tensioned yarn 1 will remain in the suction region of suction opening 18' upon release from cutting device 23.

Figure 2C:
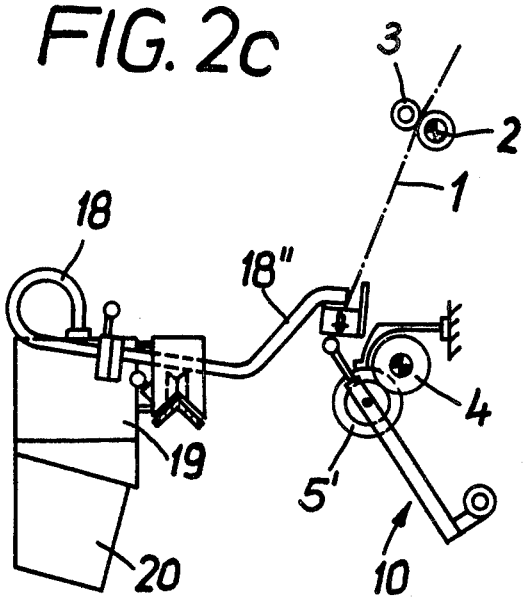

The yarn which continues to be furnished by yarn supply device 2, 3 is conveyed through the rotatably disposed entrance region 18'' of suction tube 18 under the influence of suction blower 20 into collecting vessel 19. Upon removal of the full bobbin 5, an empty bobbin 5' is inserted into bobbin holder 10 and caused to rotate by contact with winding drum 4, as shown in FIG. 2*c*.

Figure 2D:
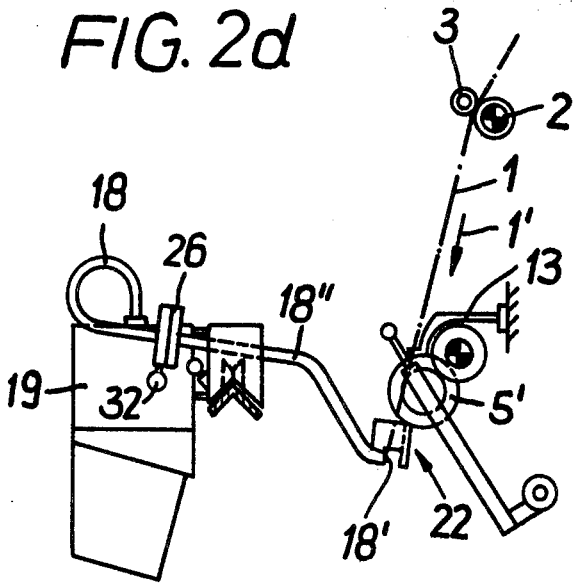

Thereafter, as shown in FIG. 2*d*, the entrance region 18'' is pivoted into the catching position, by rotating an operating lever 32, in which suction opening 18' and guide member 22 lie behind the empty bobbin 5', when seen in the direction of movement of the carried-along yarn. Upon reaching the catching position, actuation of the blades of severing device 26 causes the yarn length disposed within entrance region 18'' to be severed from the yarn downstream thereof, which has been sucked into collecting vessel 19.

Figure 3:
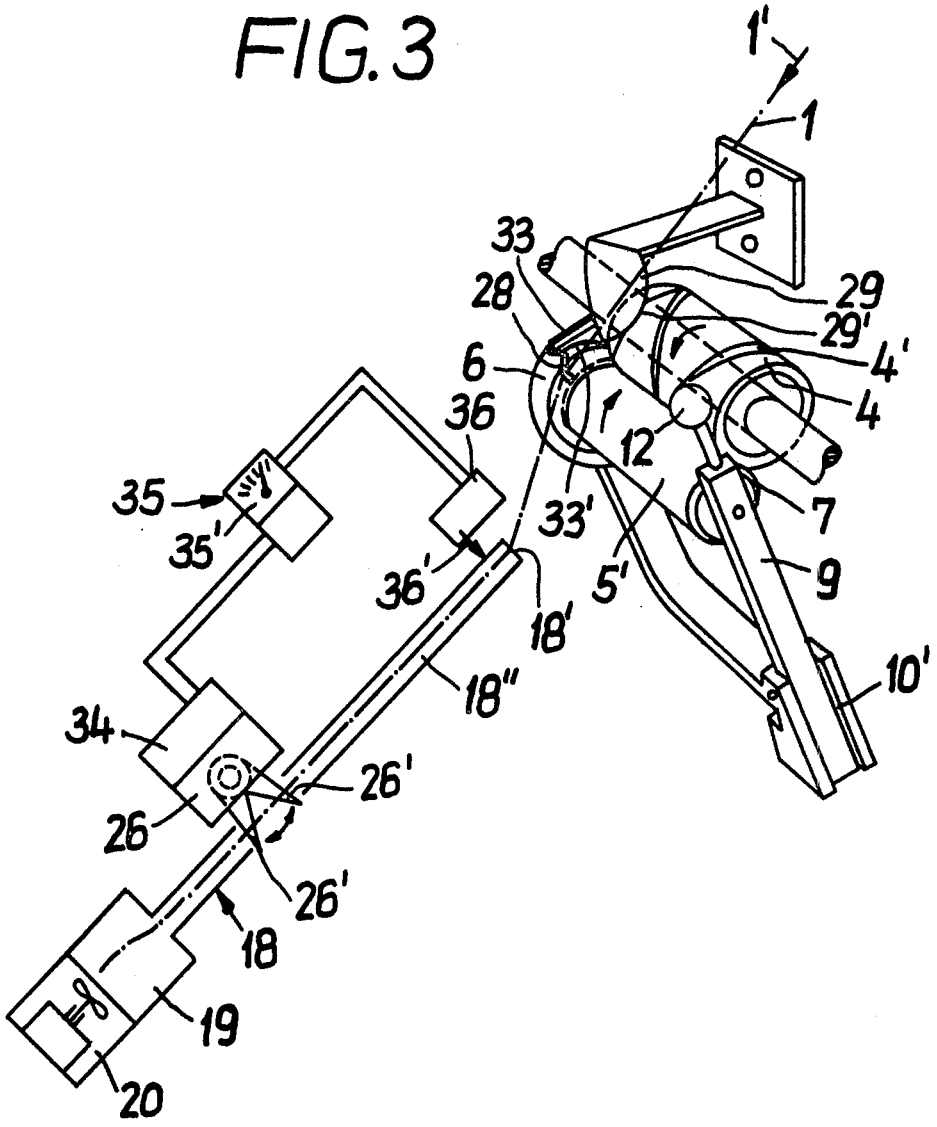
FIG. 3 is a partially schematic perspective view of an embodiment of apparatus according to the invention having a severing device which is controlled with a time delay by means of an abutment switch.

In the position shown in FIG. 2*d*, the yarn 1 is oriented, under the influence of guide 33, and specifically surface 33' of element 33 shown in FIG. 3, and guide member 22, so that the yarn length disposed between the guide 33 and member 22 intersects the plane of rotation of the hook-shaped catch element 28 at the level of the path traversed by its yarn intercepting opening and is consequently carried along in the direction of rotation of the bobbin.

Further details relating to the catching of the yarn will be apparent from the illustration in FIG. 3 and are disclosed in our copending U.S. application Ser. No. 723,493 entitled FORMATION OF RESERVE WINDING FOR FURTHER CONNECTION ON BOBBINS OF TEXTILE MACHINES and claiming priority of German Application No. P 25 41 761.2 of Sept. 19th, 1975.

After having caught the yarn, the hook-shaped catch element 28 moves with the empty bobbin 5' in the direction of the arrow appearing on the bobbin in FIG. 3 to cause the length of yarn disposed in the entrance region 18'' of suction tube 18 to be wound onto the body of empty bobbin 5', in the reserve winding region thereof, and, on the other hand, the yarn coming from the textile machine to likewise be wound on empty bobbin 5', in the principal winding region thereof, so that a loop of yarn is formed around the catch element.

The yarn length in communication with the suction tube is the reserve yarn which forms the reserve winding, while the yarn coming from the textile machine forms the principal windings on the bobbin.

The reserve yarn is deflected, under the influence of the shallow conical peripheral surface 6'' and the steep conical peripheral surface 6' of bobbin disc 6, shown in FIG. 1*b*, from the plane of rotation of catch element 28 in the direction toward empty bobbin 5', i.e. toward the right, and there forms the reserve winding 30 which simultaneously covers the ends of the loop formed around the catch element.

The winding yarn coming from the textile machine is wound onto the bobbin body of empty bobbin 5' under the influence of deflecting surface 29' of the deflector 29 outside of the reserve winding region. The deflecting surface 29' is designed so that when the winding yarn is carried along in the direction of rotation of the bobbin, a deflection takes place in the direction toward the second bobbin disc 7. This deflection has the result that the winding yarn is caught by the grooves 4' of winding drum 4 and carried along with its rotation. Guide elements 29 and 33 are advisably combined in the guiding device 13, forming a unit.

Release of a filled bobbin is effected by pivoting bobbin arm 9, which rests in a guide 10' of bobbin holder 10, in the clockwise direction.

In the embodiment shown in FIG. 3, the drive 34 of the severing device 26, which is provided with cutting blades 26', is connected, for control purposes, with an abutment switch 36 through the intermediary of a control device 35. To show the arrangement of blades 26', they are shown in FIG. 3 in a position which is at right angles to their true position relative to tube 18. The sensor 36' of abutment switch 36 is moved as a result of contact with the entrance region 18'' of suction tube 18 as soon as the latter has reached the catching position shown in FIG. 2*d*. Control device 35 is provided with a delay member 35' which transmits the switching pulse generated by movement of sensor 36' to drive 34 with an adjustable time delay.

It is therefore possible to adapt the length of the tie-on thread whose end is cut off by means of severing device 26 to different operating conditions by suitably setting the delay period of delay member 35'.

The cutting blades 26' of severing device 26 engage within suction tube 18 and constitute the outer end of entrance region 18''. Severing device 26 may additionally be arranged to be displaceable with respect to suction tube 18. This can be realized, for example, by fastening the severing device to a piece of tube which tightly encloses two spaced tube sections of suction tube 18 and thus connects the two sections together. The positioning range of severing device 26 is determined by the spacing between the two tube sections.

Figure 4:
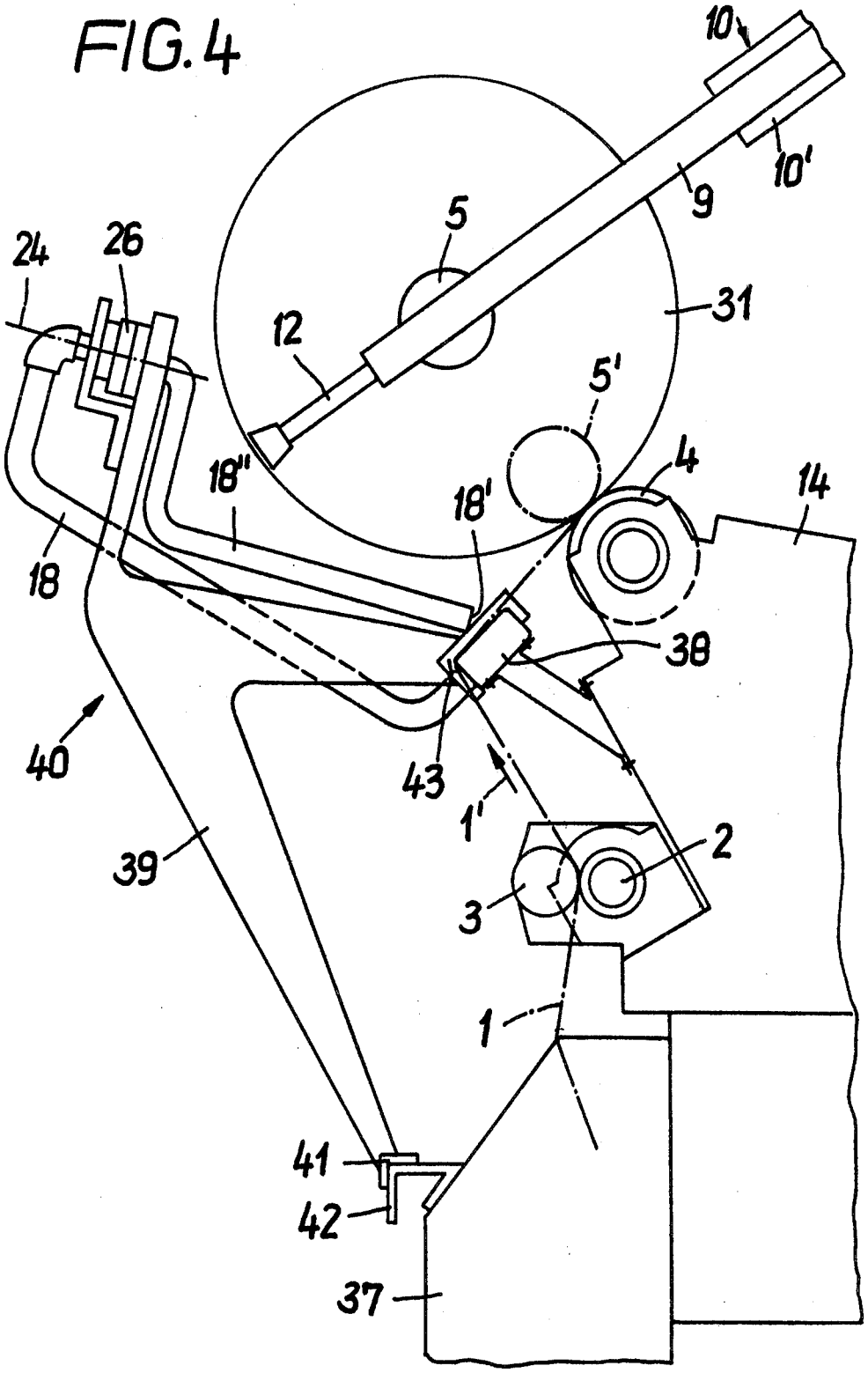
FIG. 4 is a side elevational view of an embodiment of a movable unit according to the invention which can be placed onto the frame of a textile machine in the area of the bobbin holder.

FIG. 4 shows an apparatus for forming a tie-on thread connected with an open-end spinning unit 37. The individual assemblies, such as the feed roller, break-up roller and spinning rotor, associated with the open-end spinning unit are not shown and can be constructed in the manner known in the art.

Yarn 1 produced continuously in the open-end spinning unit 37 is guided, by means of delivery roller 2 and pressure roller 3 and over a square tube 38 which serves as a guide and which is mounted on machine frame 14, into the range of winding drum 4 and is applied to bobbin 5 to form a winding 31. Suction tube 18 with its rotatably arranged entrance region 18'' and the subsequent severing device 26 are formed into a portable unit 40 supported by a substantially three-armed supporting frame 39.

The downwardly directed arm of unit 40 can be placed onto a guide rail 42 via an angled centering surface 41, the guide rail 42 being permanently connected to the housing of the open-end spinning unit 37.

The apparatus shown in FIG. 4 is composed of a plurality of spinning units spaced apart perpendicular to the plane of the drawing, and a plurality of bobbin holders each associated with a respectively spinning unit. Tube 38 extends perpendicular to the plane of the drawing through all of the bobbin locations and has its interior connected to a low pressure source.

The section of suction tube 18 which is immovably connected with unit 40 has a sealed connection 43 as its end section facing the machine frame 14, through which sealed connection suction tube 18 can be connected to the interior of square tube 38 which is under subatmospheric pressure. The sealed connection 43 which simultaneously is held by the center arm of supporting frame 39 has a U-shaped cross section formed to accurately locate the unit 40 in the region of the bobbin location.

The square tube has a sealable opening (not shown) on the side facing the outlet end of suction tube 18 in the area of each bobbin location and suction tube 18 can be connected to the interior of square tube 38, which is under subatmospheric pressure, at any one of these openings.

The entrance region 18'' is shown in the drawing in its starting position, in which suction opening 18' lies ahead of bobbin 55 with its winding 31 when seen in the direction of movement 1' of yarn 1. The position of empty bobbin 5' which is inserted into bobbin holder 10 after removal of a full bobbin is shown in dot-dash lines.

The stationary section of suction tube 18 with its seal connection 43 lies outside of the region occupied by a full bobbin 5 or an empty bobbin 5'; so that it will not interfere with the bobbin winding process or the bobbin exchanging process. The parts 22 and 23, shown in FIG. 1*a*, which are associated with suction opening 18' are not shown for the sake of simplification.

The unit 40 can be provided with suitable guide rollers to enable it to be moved easily from one bobbin location to another.

It will be understood that the above description of the present invention is susceptible to various modifications, changes and adaptations, and the same are intended to be comprehended within the meaning and range of equivalents of the appended claims.

What is claimed is:

1. In a bobbin winding method, in a textile machine, which method includes: continuously delivering yarn to the region of the bobbin by a yarn supply device, and winding the yarn onto the bobbin; after the bobbin is filled, severing the yarn at a point between the bobbin and the supply device, replacing the full bobbin by an empty bobbin, and conveying the yarn which continues to be delivered by the yarn supply device to a yarn collector by means of a suction device having an inlet region; after insertion of an empty bobbin, bringing yarn coming from the yarn supply device into engagement with a catch element which carries the yarn along in the direction of bobbin rotation to cause the bobbin to be wound with a reserve winding composed of yarn disposed between the catch element and the yarn collector and a principal winding composed of yarn subsequently delivered by the yarn supply device, the improvement comprising a method for forming a tie-on thread of defined length to constitute the reserve winding, said thread forming method including:

after a bobbin has been filled and prior to said severing step, guiding the yarn at a point between the filled bobbin and the yarn supply device by moving a guide element and the inlet region of the suction device to a first position in front of the bobbin and bringing the yarn at that point into engagement with the guide element;

subsequent to said step of severing, performing said step of bringing yarn into engagement with the catch element by moving the inlet region of the suction device and the guide element to a second position which is located at the opposite side of the bobbin from the yarn supply device and which causes the yarn present between the inlet region of the suction device and the yarn supply device to intersect the circular path of movement of the catch element for permitting the catch element to engage the yarn at a point in the catch element travel path and to extract yarn from the suction device during subsequent bobbin rotation; and cutting the yarn which has passed through the inlet region of the suction device at a predetermined point beyond the entrance region and at a selected time related to the movement of the inlet region of the suction device and the guide element into said second position for causing the yarn which constitutes the reserve winding to have a preselected, defined length.

2. A thread forming method as defined in claim 1 further comprising deflecting the yarn forming the reserve winding, immediately after engagement by the catch element, from the plane of rotation of the catch element, in the direction toward the empty bobbin, and simultaneously transferring the yarn delivered by the yarn supply device to the region is which the principal winding is formed.

3. A thread forming method as defined in claim 1 wherein said step of cutting is performed at a predetermined time after movement of the inlet region of the suction device and the guide element into said second position.

4. In apparatus for winding a bobbin in a textile machine including: a bobbin holder composed of two arms, two bobbin holding discs each rotatably mounted on a respective arm and arranged to support a bobbin at a predetermined position for rotation, and a yarn catch element mounted on the periphery of one of the discs; a yarn supply device for delivering yarn to a bobbin mounted in the holder; a yarn collector; and a suction device having an outlet end connected to the yarn collector and an inlet opening in the vicinity of the location in which a bobbin is supported by the holder, the suction device having an inlet region extending from the inlet opening toward the outlet end, the improvement comprising:

a guide member and a yarn severing device carried by said suction device in the vicinity of its said inlet opening;

means supporting said inlet region for pivotal movement between a first position in which the inlet opening is in front of the bobbin position and a second position which is located at the opposite side of the bobbin position from said yarn supply device;

a yarn cutting device located in said suction device at a variable distance from said inlet opening for cutting yarn in said suction device at a selected distance from said inlet opening;

and cutting control means connected to said cutting device for causing it to cut the yarn at such preselected distance from said inlet opening in response to movement of said inlet region of said suction device to said second position.

5. An apparatus as defined in claim 4 wherein said one bobbin disc has one or more conical peripheral surfaces for deflecting yarn disposed between said catch element and said collector in the direction toward the bobbin position.

6. An apparatus as defined in claim 4 further comprising a yarn guiding device mounted ahead of the bobbin position within the region of the plane of rotation of said catch element, said guiding device being arranged to deflect yarn disposed between said catch element and said yarn supply device in a direction toward the region where the principal winding is to be formed.

7. An apparatus as defined in claim 6 wherein said suction device, said yarn collector, said cutting device and said yarn guiding device are constituted by a movable unit which can serve a plurality of bobbins.

8. An apparatus as defined in claim 7 further comprising a stationary frame and a stationary suction line provided with a plurality of sealable connecting openings each associated with a respective bobbin location and said movable unit further comprises a supporting frame presenting a centering surface to be placed on said stationary frame, said suction device is provided with a sealed connection through which, with said centering surface properly positioned, a connection can be established with any one of the connecting openings of said stationary suction line.

9. An apparatus as defined in claim 4 wherein said suction device is constituted by a suction tube and said guide member and yarn severing device are fastened to said suction tube in a manner such that when said suction tube inlet region is in said first position, said inlet opening is located between said yarn supply device and said guide member, and said guide member is located between said yarn supply device and said severing device.

10. An apparatus wherein said cutting control means as defined n claim 4 includes an abutment switch arranged to be actuated when said inlet region is brought to said second position for operating said cutting device.

11. An apparatus as defined in claim 10 wherein said cutting control means further includes a delay member for delaying operation of said cutting device for a preselectable permanently settable delay period after actuation of said abutment switch.

* * * * *